US006816137B2

(12) United States Patent
Leja

(10) Patent No.: US 6,816,137 B2
(45) Date of Patent: Nov. 9, 2004

(54) VISUAL MESSAGE DISPLAY DEVICE

(75) Inventor: Frank Leja, Belchertown, MA (US)

(73) Assignee: Newscanner, PLC, London (GB)

( * ) Notice: Subject to any disclaimer, the term of this patent is extended or adjusted under 35 U.S.C. 154(b) by 447 days.

(21) Appl. No.: 09/784,371

(22) Filed: Feb. 15, 2001

(65) Prior Publication Data

US 2002/0145576 A1 Oct. 10, 2002

(51) Int. Cl.[7] ..... G09G 3/32

(52) U.S. Cl. ..... 345/82; 340/815.53; 340/815.5

(58) Field of Search ..... 345/82, 85, 81, 345/83, 88, 98, 99, 204, 207, 214; 340/815.44, 815.53, 815.5

(56) References Cited

U.S. PATENT DOCUMENTS

| | | | | |
|---|---|---|---|---|
| 4,555,857 A | * | 12/1985 | Christoffel et al. | 33/561 |
| 5,796,362 A | | 8/1998 | Ayasli et al. | |
| 6,265,984 B1 | * | 7/2001 | Molinaroli | 340/815.4 |
| 6,438,882 B1 | * | 8/2002 | Reynolds | 40/642.02 |

FOREIGN PATENT DOCUMENTS

| | | |
|---|---|---|
| DE | 296 11 155.4 | 6/1996 |
| DE | 296 21 296.2 | 12/1996 |
| DE | 197 O2 751.2 | 1/1997 |
| DE | 297 04 397.2 | 1/1997 |
| WO | 90/12354 | 10/1990 |
| WO | 97/50070 | 6/1997 |
| WO | 98/33164 | 1/1998 |

OTHER PUBLICATIONS

Lumino Elektronische Informationssyteme, *Magicball® User Manual*, 1997.

* cited by examiner

*Primary Examiner*—Bipin Shalwala
*Assistant Examiner*—Mansour M. Said
(74) *Attorney, Agent, or Firm*—Davis & Bujold, P.L.L.C.

(57) ABSTRACT

An alphanumeric and graphic symbol display device in which an LED array is rotated and controlled to project a display onto a translucent surface. The electrical power for the array is provided by way of a rotating contactless transformer independently of the control data for the array which is provided by infrared data transmission through a tubular shaft driven by a DC brushless, three-phase motor to rotate the array at a predetermined rate independent of the electrical power for the array and the control data.

11 Claims, 1 Drawing Sheet

VISUAL MESSAGE DISPLAY DEVICE

FIELD OF THE INVENTION

The present invention relates to a remotely controlled alphanumeric and graphic symbol display device incorporating a vertical array of light emitting diodes (LEDs) and digital imaging techniques to display messages, information, advertisements, news etc. The alphanumeric and graphic symbol display is manifested as an illuminated visual display on a stationary screen by the light emitted from the array of LEDs when electrically charged while the arm rotating at a desired speed.

BACKGROUND OF THE INVENTION

The readily accessible display of news and information, particularly in view of the rapidly changing and increasing speed of modern telecommunications, is becoming increasingly critical for use in commercial enterprises, leisure businesses and to the community at large. Display's of the type typically known in the industry are currently advantageously provided by electronic display signs, e.g. the "Travelling Word" screen display devices applying conventional LED matrix architecture, for instance LED's arranged in rows and columns in a matrix configuration, for use in stock exchanges or for public messaging and advertisements were invented, developed and installed in the early 1980s. These screens provided ready access to fiscal information that, by its very nature is constantly and rapidly changing.

The use of LEDs as light sources in patterns of rows and columns for displaying information is well known. Various features are comprehensively described in U.S. Pat. No. 5,796,362 issued to Banks. In that patent are disclosed large modular, electronic display sources comprising a sign controller, sign systems buses for data transmission, display panels, and panel control cards associated with each panel. This display sign supports for example 512 LEDs.

A static display unit is also disclosed in international patent application WO 90/12354 to Stella Communications Limited which is described as mounted on a motor driven, rotary unit. The unit provides cylindrical display from LEDs arranged in vertical columns which sweep around a cylindrical surface. The rotating unit carries a unit for controlling the LEDs and a memory.

Both international application filed by Lumino Licht Electronik GmbH, ("Lumino") numbers WO 97/50070 published on Dec. 31, 1997 and WO 98/33164 published on Jul. 30, 1998, relate to rotational display devices within a housing. WO 97/50070 describes a device for displaying alphanumeric characters and/or symbols, within a rotationally symmetric housing (19) of a transparent and/or translucent material; the housing (19) contains an electric motor (2) with a motor shaft (20) which revolves around a symmetrical axis (21); a carrier (5) which is rotationally fixed to the motor shaft (20) and on which is attached at least one row of light-emitting diodes or groups of light-emitting diodes (6) that are substantially perpendicular to the motor shaft (20); and a circuit board (4) with a control circuit for the light-emitting diodes (6). To improve control of the display device and the LED's and to provide for a technically simple series production, the display device also has an opto-electronic measuring device (15) made of a transmitter (22) and receiver (23), to measure the rotating speed of the carrier (5) for synchronizing control of the light-emitting diodes (6) with the rotating speed of the carrier (5), the transmitter and receiver are fixed to a rotating structural part of the device on the one hand and to a stationary structural part of the device on the other hand, at a short distance apart. With the use of software the signal picked up by the receiver can be converted into a clear square-wave signal, free from external interference so that the LED-control can be synchronized with the exactly or almost exactly measured rotating speed of the carrier (5). The device according to the invention also contains a mechanical balancing element (6, 8) opposite the carrier (5) in relation to the symmetrical axis (21), wherein the balancing element (7, 8) is a rod (7) of any cross-section, the operating length of which can be shortened, the rod being raised into a substantially horizontal position during operating.

WO 98/33164 relate to a spherical display device with a circuit board (4), accommodated inside a spherical housing (31), with drive and control elements and electronic components, as well as a support (5) rotating inside the housing (31) for light-emitting diodes or light-emitting diode groups (6). Transmission of electric energy onto the circuit board (4) is conducted by contactless inductive energy transmission. It is a critical feature of both WO 97/50070 and WO 98/33164 that contactless inductive transmission of electrical energy and/or data is provided to the circuit board and its circuits. It is also a critical feature to interface the device with programming means to control to the LEDs synchronously with the rotating speed of the carrier which, preferably, is rotated by a synchronous motor.

A disadvantage of the prior art proposals is the use of an induction motor having windings on its rotor connected to a power supply by slip rings or brushes which are disconnected to reduce wear with the slip rings being short circuited so that the rotor functions essentially as a squirrel cage motor (a slip ring induction motor). This type of motor is susceptible to wear and production of electrical noise potentially interfering with data controlling the LED display.

SUMMARY OF THE INVENTION

It is an object of the invention to provide a rotating information display system having an architecture that is capable of rapidly receiving and consistently displaying and disseminating any relayed data or information.

It is another object of the invention to provide a display device that is, reliable and easily transportable from one location to another. In particular, the display system has advantages of reliability, cost saving and space-saving, i.e. it can be desk-top size or ceiling or the more usual wall-mount.

It is a still further object of the present invention to provide a device that makes an infinite range of displayed information accessible at reasonable cost to businesses, particularly small businesses and the community-at-large.

Another object of the present invention is to provide a device of the kind set forth in the opening part of this specification, which, in a technically simple and in a wear-free manner, provides reliable energy and data transmission to the circuit board and rotating display elements and display circuits.

To achieve this end, the display device is such, that the electronic motor control for rotating the LED's, the electronic data transmission control and the circuit board power supply are kept entirely separate, independent and mutually exclusive. This separation is necessary in order that a smooth transmission of data is provided to the circuit board which controls the LED's. Thus the data flow and transmission to the circuit board and thus the display of the desired information will not be interrupted or interfered with as they would in a device which must simultaneously control the functions and operations of the motor and data transmission.

To this end, the motor is a DC brushless, three-phase motor operated by a series of pulses to accurately control rotational speed. This DC brushless, three-phase motor provides appropriate rotation of the LED's, operates on a completely separate control circuit, than that used to control the data transmission flow and the inductive energy transmission used as a contactless energy transmission to the circuit board.

According to one aspect of the invention provides a display device for visually displaying illuminated graphic and alphanumeric symbols on a screen, the display device comprising: a tubular drive shaft defining an axis of rotation; a housing substantially encompassing a motor for driving the hollow drive shaft; a PCB supported at one end of the tubular shaft for rotation therewith; an array of light emitting diodes mounted to the PCB for rotation therewith; a central processing unit positioned on the circuit board for controlling an actuation sequence of the light emitting diodes; a contactless rotary transformer for supplying electrical power to the circuit board, central processing unit and light emitting diodes; and an optical receiver positioned on the circuit board for directly receiving display control data for the central processing unit from a remote source through the tubular shaft from an optical transmitter.

According to another aspect of the invention provides a moving display device comprising: a) a vertically oriented LED array for projecting a moving display onto a translucent surface; b) a shaft for rotating the LED array about a longitudinal axis of the shaft, the shaft being tubular; c) an infrared data receiver for receiving control data, for the LED array to produce the moving display, through the tubular shaft along said axis from an infrared data transmitter; d) a CPU to control the LED array in response to the received control data; e) a data entry unit to operate the infrared data transmitter to transmit the control data through the tubular shaft for receipt of the infrared data receiver; f) the rotary contactless transformer for inductively providing power to operate the CPU and LED array; and g) a DC brushless, three-phase electric motor connected to rotate the shaft about said axis of a predetermined rate independent of the control data transmission and CPU and LED array power supply.

According to another aspect of the invention provides a moving display device comprising: a) a vertically oriented LED array for projecting a moving display onto a translucent surface; b) a shaft for rotating the LED array about a longitudinal axis of the shaft, the shaft being tubular; c) an infrared data receiver for receiving control data, for the LED array to produce the moving display, through the tubular shaft along said axis from an infrared data transmitter; d) a rotary contactless transformer for inductively providing power to operate the LED array; and e) a DC brushless, three-phase electric motor connected to rotate the shaft about said axis of a predetermined rate; wherein the power supply for the motor, the control data transmission and the LED array power supply are independent of one another.

BRIEF DESCRIPTION OF THE DRAWINGS

The invention will now be described, by way of example, with reference to FIG. 1 which is a diagrammatic partially sectioned illustration of a display device according to the present invention.

DETAILED DESCRIPTION OF THE PREFERRED EMBODIMENTS

Figure 1:
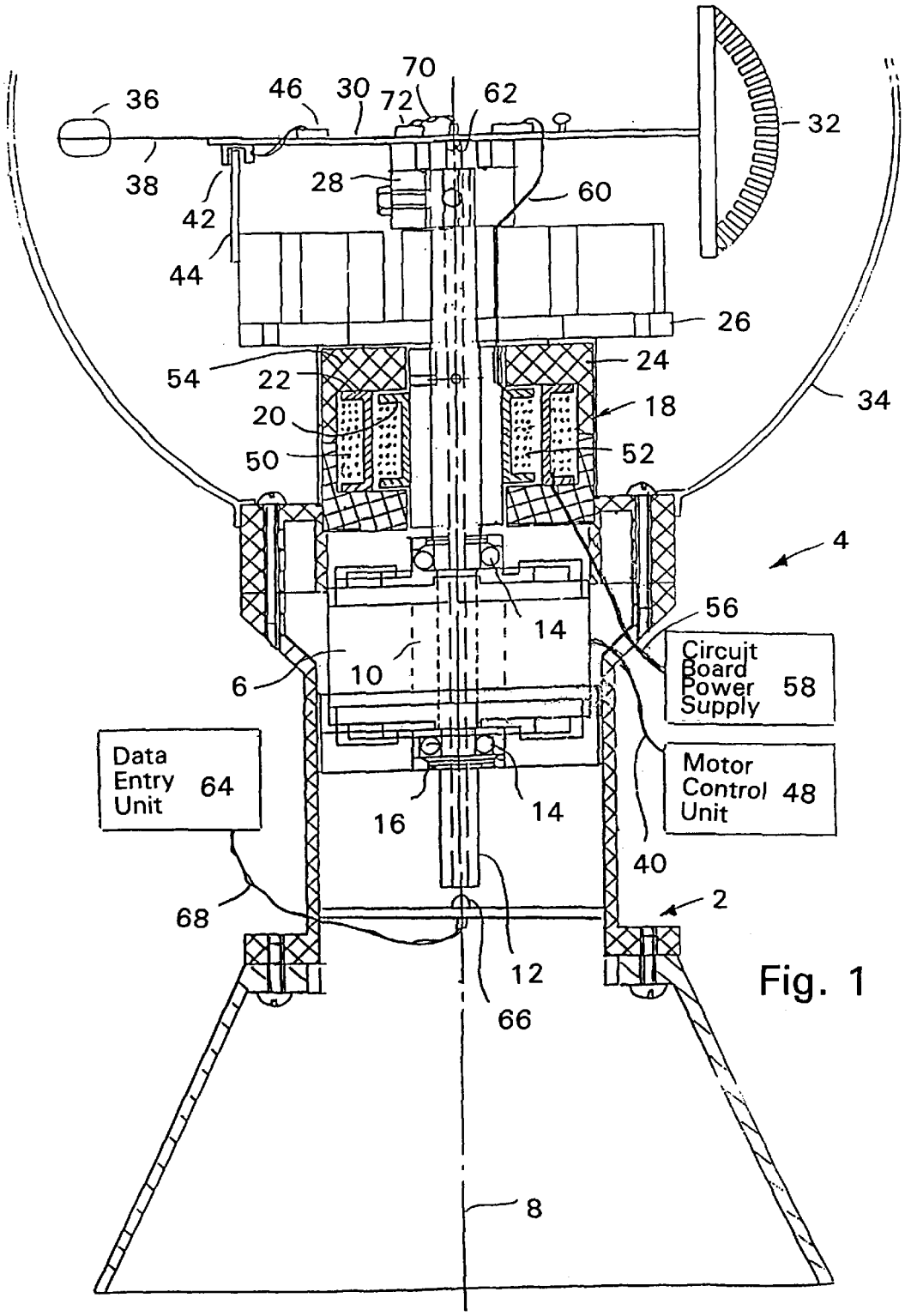

With reference to FIG. 1, a vertically oriented, support structure 2 of the display device 4 supports a motor 6, defining a vertical axis 8 of symmetry and rotation for the device 4, having a rotor 10 connected to rotate a vertical tubular shaft 12 about axis 8. The rotor 10 and shaft 12 are supported for rotation, by the motor 6, by spaced ball bearings 14 the lower of which is associated with a thrust bearing 16 to axially support the shaft 12.

Above the motor 6, the structure 2 supports a rotary transformer 18 having an inner bobbin 20 attached to the shaft 12 for rotation therewith and an outer bobbin 22 supported by a stationary transformer housing 24 which is connected to a stationary heat sink 26 for the transformer 18.

The shaft 12 extends through the heat sink 26 to a connector 28 on which a printer circuit board (PCB) 30 is mounted for rotation with the shaft 12. The PCB supports a single vertically oriented arcuate array 32 of LEDs (a plurality of arrays could be used) and control circuit components 46 (CPU) to provide a desired alphanumeric-graphic display, responsive to data input, and visually displayed as a rotating display visible to an observer on a spherical translucent globe 34 which is supported on structure 2 and centered on the axis 8 and the plane of the PCB 30.

Although described as a glob in this exemplary detailed description, it will be appreciated that the spherical translucent globe 34 could be a translucent cylindrical surface or other translucent surface.

The PCB 30 also supports a balance weight 36 by way of a leaf spring 38.

The motor 6 is a DC brushless, three-phase electric motor. This DC brushless, three-phase electric motor turns the drive shaft 12 and drives the circuit board platform upon which rests the LEDs. The DC brushless, three-phase motor 6 is connected to the local supply voltage by way of a standard supply cable 40 through an entrance in the support structure 2, the motor being supplied with all power necessary for the display device to function in accordance with the invention herein described. The body of the DC brushless, three-phase motor 6 is wound to match the required operating voltage.

The minimum optical speed of a single row of LEDs in order to make the message look smooth has been found to be 1750 rpm: at 1200 rpm a light flicker is seen, while 3000 rpm is too fast, and at the same time generates more power requirements than are needed. The optimum revolutions per minute of the DC brushless, three-phase motor 6 is somewhere between 1500 rpm and 1800 rpm. This has been achieved without the necessity of designing elaborate controls for the DC brushless, three-phase motor 6. In the preferred embodiment, the optimum speed is 1700 rpm. A "tick indicator" 42 signals to the circuit board where it is in the 360 degree cycle of every revolution. This device indicates where zero is in each rotational cycle, of the printed circuit board and determines a fixed point on which the LED indicator cycle breaks.

The tick indicator 42 is located on the PCB 30 with a stationary tick producing bar 44 attached to the heat ink 26. This indicator 42 is an optical sensor, activated by the bar located on the heat sink 26 which breaks a light beam thereby indicating, to the processing device that the rotating arm has traveled 360 degrees since the preceding tick. The microprocessor 46 on the PCB 30 is independent of motor speed torque or any voltage variations, The software is designed to position the DC brushless, three-phase motor 6 precisely at any given point during very revolution, so that once the microprocessor 46 receives the intended signal, the software will refresh or upgrade existing data to later data in its memory and check the internal software to insure nothing has corrupted the data. In this way, the software, in the manner of its design, maintains stability throughout the display system. At the point of manufacture, the DC brushless, three-phase motor 6 is fixed at 2450 rpm.

It has been found that with particular advantage, the DC brushless, three-phase motor 6 is operated with pulse-width modulated signals generated by a motor control unit by a microprocessor 48. These signals are sent to the DC brushless, three-phase motor 6 through electronic circuits on a high frequency pulse averaging 25 to 30 microseconds in length. Each pulse will drive a phase of the DC brushless, three-phase motor 6. For a certain length of time, a pulse will shut phase A off; turn phase B on, to cycle the motor through 30 degrees in 26 microseconds; as phase B turns on, A shuts off: and so on. Accordingly, if phase C is turned on, phase B in the cycle will be turned off. These cycles will continue very rapidly. In this way, the required RPMs of the rotating arm are met. It follows that a digital signal is generated off the microprocessor 48 with pulse-width modulation: as opposed to the operation of an AC induction motor, which constantly has power on it.

Some other advantages of the motor 6 as provided in the present invention are (a) it can work with different power requirements worldwide so that it operates the whole mechanism internationally; (b) it has requirements for a third less power in operation; only one phase at a time is called for, on the pulse-width modulated signal; (c) less heat is generated since the power requirements of the inventions are less than conventional power units; (d) less operating noise is generated by the invention; any noise generated is an electronic noise which (as opposed to non-absorbent material induction motor 6 which will give off an irrepressible 60 or 120 cycle hum) can be filtered out with an RC networks or some other filtering circuit to make the motor 6 electrically quiet. With a DC brushless, three-phase motor 6, it is possible to filter noise out because there is no vibration of the wires, as it is using DC signals which give off only a very high frequency in the region of 4 kHz. Such a high frequency noise can readily be filtered out with a capacitor and a resistor: in consequence, FCC requirements will be met; (e) a magnetic core replaces a winding, which is cylindrical, is coated and contained in a protective plastic; (f) the transformer cap for the rotary transformer is designed in such a way as to transfer any heat generated by the transformer to be dissipated over the fins located to he top of the cap.

Due to the high speed of rotation at the drive shaft 12 of the motor 6 of 2450 rpm a "stationary" or "still" image with an image repetition rate of about 50 Hz is generated for the person viewing the display device. Depending on the predetermined and programmed memory content that image can be still or moving script comprising alphanumeric characters and also graphic images. It will be appreciated that combinations of such characters and images are also possible.

In order to achieve a greater reading angle for the person viewing the display device, the LED-heads of the array 32 can be beveled, with the beveling preferably being perpendicular to the vertical. In addition it is alternatively possible to use SMD-LEDs.

The flexible (elastically deflectable) leaf spring 38 is fixed to the side of the circuit board 20, opposite the LED array 32. The weight 36 is disposed at the free end of the leaf spring 38 and is vertically displaceable under the effects of centrifugal force to provide for optimum weight equalization to balance the structure about axis 8.

At the beginning of the rotary movement of the arrangement about the axis of the rotation the sagging leaf spring by virtue of the increasing centrifugal force, moves toward a horizontal orientation to stabilize and weight compensate the device during operation.

The display globe 34 is preferably about 30 cm in diameter and has a receiving opening through which the above described arrangement is introduced into the display globe 34. However, larger globes are contemplated.

Because the motor 6 is powered by a completely separate circuit and control from the PCB 30, i.e. there is no direct connection from the motor 6 to the PCB 30 to facilitate a cooperative change in the LED sequence. Hence the PCB 30 must itself measure the speed at which it is rotating. This is accomplished in the present invention by means of the tick indicator 42.

There are 3 functions of the present invention which must be carried out independently from one another for the integrity and dynamic feasibility of the display device. Firstly, as discussed above power must be provided to the motor 6 in order to rotate the shaft 12, PCB 30 and LED array 32 at the necessary speed. Secondly, independent of the power supply to the motor 6, constant and consistent power must be provided to power the PCB 30. Thirdly, data used by LED array 32 controlling the CPU 46 on the PCB 30 to display the desired text or graphics must be consistently transmitted to the PCB 30. The second and third functions of the device are carried out in the present invention by contactless energy and data transmission respectively to alleviate problems caused by contacting, brushing or slipping parts, a further discussion of both are provided below.

The induction law is implemented for contactless transmission of electrical energy to the PCB 30. This involves making use of the fact that a voltage is generated (induced) in an electrical conductor when the magnetic flux through a surface embraced by that electrical conductor changes in respect of time. As a result a current flows upon closure of the circuit without a voltage source being present in the circuit. Voltage generation is effected under certain necessary conditions in accordance with the law:

- when the electrical conductor is so moved in a magnetic field that it cuts the magnetic field lines:
- when the electrical conductor is held fast and the magnet is moved:
- when the electrical conductor and the magnet are held fast but the magnetic field is changed:
- when the electrical conductor and the magnet are at rest and with a fixed magnetic field a substance with a different relative permeability is introduced into the magnetic field: or
- when the electrical conductor is deformed.

In all the above-depicted situations voltage induction is therefore effected by a change in respect of time in the magnetic flux.

In order to provide power to the LED's and other components on the PCB 30 and to control the text and graphics displayed by the device, and to ensure the longevity of the device, it is desirable to use a contactless power transformer.

As described, there is provided a contactless rotary transformer 18. The rotary transformer 18 has a stator 22 having a primary winding 50 and a rotor 20 having a secondary winding 52 in conjunction with a ferrite magnet 54 for inducing an electrical potential. The secondary winding 52, which is attached to the drive shaft 12. The windings 50, 52 and bobbins 20 are nested concentric windings housed within the ferrite magnet housing 24 which comprises two half shells arranged with their free ends spaced apart thereby forming an air gap between them. Connected with the ends of the turns of the primary winding 50 is an electrical connection cable 56 to supply electrical power from a circuit board power supply 58 while the ends of the secondary winding 52 are electrically connected through the heat sink 26 by an secondary electrical connection cable 60 to supply electrical power to the PCB 30.

The rotation of the secondary winding within the energized primary winding induces a magnetic flux in the secondary winding which in turn generates current in the secondary cable 60. The transformer operates in the same manner as any traditional transformer and may step down the power just as in a traditional transformer. The secondary cable 60 provides power to the PCB 30 without any need for any physical contact between structural parts whatsoever.

It is important that the drive shaft 12 be a hollow tube. The drive shaft 12 thus defines a longitudinal through bore, along axis 8 extending between a first and second ends of the drive shaft 12 through which data transmission to the rotating PCB 30 can be made.

The hollow drive shaft 12 has the first end vertically supported on the thrust bearing 16 and laterally supported by bearings 14 spaced along the shaft 12 and is driven by the motor 6 as set forth above. The drive shaft 12 extends upwardly from the base housing and supports the inner bobbin 20 and secondary winding 52 which, as previously discussed, provides power to the PCB 30 and LED array 32 mounted at the upper end of the drive shaft 12. Finally, the upper end of the drive shaft 12 supports the PCB 30 and its components, arm 44 and LED array 32.

On the rotating LED board, an infrared receiver 62 is located on a bottom surface thereof on axis 8. The infrared receiver is thereby located to receive infrared data through the shaft 12 along the axis 8 and has a direct line of sight all the way to the lower end of the shaft 12. This prevents room light or other interfering lighting or objects interfering with a data signal to received by the infrared receiver 62. This feature relates only to the transmission of data. A data entry unit 64 accepts infrared keyboard RS232 data, RS45 data network data, to facilitate as many ways as possible of communicating with PCB 30. This is independent of any electrical connection to the drive motor or the power generator for the PCB 30. Being totally independent, it allows greater accuracy for the transmission of data to the PCB 30.

Located in the base of the structure 2 is an infrared data transmitter 66. Positioned to transmit data, received by cable 58 from the data entry unit 64, through the tubular shaft 12 to the infrared receiver 62 for onward transmission by cable 70 to the CPU 46 of the PCB 30 to control the operation of the LED array 32 to produce a desired alphanumeric and/or graphical display with timing inferenced by the tick indicator 42.

As to the transmission of data to the LED array 32, there is a dynamic memory access controller 72) handles data movement between the infrared processor and the PCB 30. Data movement operations are controlled by the CPU 46 provide output display data from the memory of the microprocessor to control operation of the LED array 32.

| Reference numbers | |
|---|---|
| 2 support structure | 38 leaf spring |
| 4 display device | 40 motor supply cable |
| 6 motor | 42 tick indicator/optical sensor |
| 8 axis | 44 arm |

-continued

| Reference numbers | |
|---|---|
| 10 motor rotor | 46 microprocessor (CPU) |
| 12 shaft | 48 motor control unit |
| 14 ball nearing | 50 primary winding |
| 16 thrust bearing | 52 secondary winding |
| 18 transformer | 54 ferrite magnet |
| 20 inner bobbin | 56 primary cable |
| 22 outer bobbin | 58 power supply |
| 24 transformer housing | 60 secondary cable |
| 26 heatsink | 62 infrared receiver |
| 28 connector | 64 data entry unit |
| 30 PCB | 66 infrared transmitter |
| 32 array | 68 cable |
| 34 display globe | 70 cable |
| 36 weight | 72 memory access controller |

What is claimed is:

1. A display device for visually displaying illuminated graphic and alphanumeric symbols on a screen, the display device comprising:

a hollow tubular drive shaft defining an axis of rotation;

a housing substantially encompassing a motor for driving the hollow drive shaft;

a circuit board (PCB) supported at one end of the tubular shaft for rotation therewith;

an array of light emitting diodes mounted to the circuit board for rotation therewith;

a central processing unit on the circuit board for controlling an actuation sequence of the light emitting diodes;

a contactless rotary transformer for supplying electrical power to the circuit board, central processing unit and light emitting diodes; and an optical receiver connected to the circuit board for directly receiving display control data for the central processing unit from a remote source through an optical transmitter;

wherein the hollow tubular drive shaft defines a longitudinal passage extending and from a first end to a second, opposite, end of the drive shaft, providing a direct, unobstructed passageway between the optical receiver on the circuit board and the optical transmitter; and wherein the contactless rotary transformer comprises a stator having a permanent magnet surrounding a primary winding and a rotor, attached to the drive shaft, having a secondary winding wherein a voltage is induced in the secondary winding across a gap between the stator and rotor to supply electrical power to the circuit board, central processing unit and light emitting diodes the windings being nested and concentric with the axis.

2. The display device as set forth in claim 1 comprising a data entry unit which operates the optical transmitter to transmit display data to the optical receiver, the transmitter and receiver both being infrared devices.

3. The display device as set forth in claim 1 wherein the permanent magnet encompasses a primary bobbin upon which the primary winding is wound, and the rotor further comprises a secondary bobbin supporting the secondary winding.

4. A display device for visually displaying illuminated graphic and alphanumeric symbols comprising:

a housing containing a motor connected to a hollow drive shaft;

the hollow drive shaft supporting;

a circuit board mounted on the hollow drive shaft;

an array of light emitting diodes controlled by the circuit board;

an optical receiver connected to the circuit board for receiving display control data for the array of light emitting diodes;

a contactless rotary transformer for supplying electrical power to the circuit board and array of light emitting diodes;

an optical transmitter for sending display control data to the optical receiver through the hollow drive shaft; and wherein the contactless rotary transformer comprises a stator having a permanent magnet and a primary winding, and a rotor attached to the hollow drive shaft, the rotor having a secondary winding wherein a voltage is induced in the secondary winding across a gap between the stator and rotor to supply electrical power to the circuit board, and light emitting diodes, the primary and secondary windings being nested and concentric about the hollow drive shaft.

5. The display device as set forth in claim 4 wherein the hollow drive shaft defines a longitudinal axis along which the optical receiver and optical transmitter are aligned.

6. The display device as set forth in claim 5 wherein the optical transmitter is stationary and the optical receiver is rotatable with the drive shaft, and the display control data is sent by the stationary optical transmitter to the optical receiver along the longitudinal axis.

7. The display device as set forth in claim 6 wherein the display control data for controlling the light emitting diodes is transmitted between the optical transmitter and the optical receiver and through the hollow drive shaft to the circuit board.

8. The display device as set forth in claim 6 wherein the optical receiver is positioned at any point along the hollow drive shaft for receiving display control data from the optical transmitter along the longitudinal axis.

9. The display device as set forth in claim 4 wherein the hollow drive shaft defines a passage extending from a first end to a second, opposite end of the drive shaft, and the optical receiver is mounted on the first end adjacent the optical transmitter and connected to the circuit board at the second end of the drive shaft through the passage of the hollow drive shaft.

10. The display device as set forth in claim 4 wherein the hollow drive shaft defines a passage extending from a first end to a second, opposite, end of the drive shaft, and the optical receiver is connected to the circuit board at the second end of the drive shaft and receives the display control data from the optical transmitter through the passage of the hollow drive shaft.

11. The display device as set forth in claim 10 comprising a data entry unit which instructs the optical transmitter to transmit display data to the optical receiver, the transmitter and receiver both being infrared devices.

* * * * *